US007481740B2

(12) United States Patent
Colling

(10) Patent No.: US 7,481,740 B2
(45) Date of Patent: Jan. 27, 2009

(54) TRAMPOLINE ACCESSORIES

(75) Inventor: Michael J. Colling, Brigham City, UT (US)

(73) Assignee: Skywalker Holdings, LLC, Brigham City, UT (US)

( * ) Notice: Subject to any disclaimer, the term of this patent is extended or adjusted under 35 U.S.C. 154(b) by 157 days.

(21) Appl. No.: 11/439,737

(22) Filed: May 24, 2006

(65) Prior Publication Data

US 2006/0270525 A1 Nov. 30, 2006

Related U.S. Application Data

(60) Provisional application No. 60/684,106, filed on May 24, 2005.

(51) Int. Cl.
*A63B 5/11* (2006.01)

(52) U.S. Cl. ..... 482/27; 482/28

(58) Field of Classification Search ..... 482/27–32
See application file for complete search history.

(56) References Cited

U.S. PATENT DOCUMENTS 3,201,126 A 8/1965 Nissen
4,336,933 A 6/1982 Appelbaum
4,478,420 A * 10/1984 Sowards ..... 473/435
4,569,515 A * 2/1986 Gordon ..... 473/473
D362,478 S 9/1995 Wilkinson et al.
5,941,798 A * 8/1999 Coan et al. ..... 482/27
6,135,922 A * 10/2000 Nissen ..... 482/27
6,261,207 B1 * 7/2001 Publicover et al. ..... 482/27
6,607,468 B1 * 8/2003 Nichols et al. ..... 482/27
2005/0043122 A1 2/2005 Publicover et al.
2005/0143225 A1 6/2005 Adams
2006/0058123 A1 3/2006 Publicover
2006/0189443 A1 8/2006 Finlinson et al.

* cited by examiner

*Primary Examiner*—Lori Amerson
(74) *Attorney, Agent, or Firm*—Kirton & McConkie; Evan R. Witt

(57) ABSTRACT

Trampoline accessories are described herein that may be affixed to a trampoline system to facilitate the playing of a game. These trampoline accessories may include a soccer net, a rebounding surface that will bounce a ball back to the thrower, and a catch panel that will gather the ball when the ball is thrown against the panel. These accessories may be added to either the trampoline frame of the trampoline enclosure. Deflective netting may be provided adjacent the accessories to prevent the ball and users from entering the space below the trampoline rebounding mat.

17 Claims, 4 Drawing Sheets

TRAMPOLINE ACCESSORIES

CROSS-REFERENCED RELATED APPLICATIONS

This application claims the benefit of U.S. Provisional Application No. 60/684,106, filed May 24, 2005 entitled "Trampoline Accessories." This provisional application is expressly incorporated herein by reference.

BACKGROUND OF THE INVENTION

Trampolines are widely known and used for a variety of recreational and athletic purposes. Recreational and "backyard" use of trampolines is very popular. Parents often buy a trampoline so that their children can enjoy hours of diversion playing and "jumping" on the trampoline.

As a result of careless use of trampolines and poorly designed/manufactured systems, personal injury has occurred. Such injuries have resulted from a person jumping too close to the edge of the trampoline surface such that the person would either (1) fall off of the trampoline or would (2) strike the frame, a tree, or another hard surface positioned proximate the trampoline's boundary. Of course, such injuries are a grave concern for many trampoline manufacturers and trampoline enthusiasts.

In order to prevent these types of injuries, trampolines have recently been sold and produced having a flexible fence or enclosure that surrounds the perimeter of the trampoline's rebounding surface. One example of this type of trampoline is disclosed in U.S. Pat. No. 6,053,845 (which will be referred to herein as the "'845 patent" and is expressly incorporated herein by reference). In these types of trampolines, any person that jumps on the trampoline will be maintained on the interior of the trampoline. Thus, when the child approaches the edge of the trampoline's rebounding mat, the enclosure will prevent the child from falling off the trampoline. Likewise, because the enclosure is made of a flexible material (such as netting, mesh, etc.), the enclosure will also prevent the child from harmfully impacting the trampoline's frame or other hard surfaces. In this manner, the enclosure will greatly increase the safety of the trampoline.

Furthermore, the trampoline with the enclosure allows children to play a variety of different games using the enclosure and other equipment (such as balls, etc.). In fact, the '845 patent teaches a variety of games that may be played by children using the trampoline and the enclosure. Unfortunately, many of the games listed in the '845 patent are difficult to play and are not interesting to older children/teenagers. Accordingly, there is a need in the art for various trampoline games that interest older children and will include, for example, sports and sporting events.

Moreover, one disadvantage of trampolines is that they can take up large areas of space. Some sports and recreational activities, on the other hand, often require large, open spaces (such as fields, etc.) in order to played properly. People often cannot play or practice sports in the same area as the trampoline for fear that the trampoline will interfere with the game.

In addition, trampoline manufacturers recommend that only one person jump at a time on the rebounding mat. Often while one person jumps, others must wait their turn. It would be a significant advancement in the art to provide a new type of trampoline which permits a variety of other sports and recreational activities to be practiced in the same area while the trampoline is in use. Such a device is disclosed herein.

BRIEF SUMMARY OF THE INVENTION

A trampoline having a safety enclosure that surrounds the rebounding surface is disclosed. However, the trampoline also has an independent game playing accessory that is positioned between two of the poles. In some embodiments, the game playing accessory may be a soccer net that is positioned on the ground between two of the trampoline legs. The soccer net is designed such that it will function as a soccer goal.

In other embodiments, the game playing accessory may be a rebound panel that is made of flexible material. The rebounding panel may be, depending upon the embodiment, positioned between the trampoline legs such that it is below the rebounding surface or may be positioned between the support poles of the enclosure such that it is above the rebounding surface.

The rebounding panel is designed so that if a ball impacts the rebounding panel, the ball will bounce off the rebounding panel and return to the user (such as a child, teenager, or adult). Thus, the child could practice throwing a ball, kicking a ball, hitting a ball, etc. without being required to spend unnecessary time chasing the ball.

In other embodiments, the game playing accessory may be catch panel. Again, this catch panel may be positioned above the rebounding surface or below the rebounding surface. The catch panel may include a receptive surface. In some embodiments, this receptive surface will include a temporary adhesive (such as Velcro®, hook and loop fasteners, and the like) such that when the ball contacts the catch panel, the receptive surface will engage the ball and/or cause the ball to stick to the receptive surface.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the trampoline accessories of the present invention, as represented in the Figures, is not intended to limit the scope of the invention, as claimed, but is merely representative of presently preferred embodiments of the invention.

As described in greater detail above, trampolines and trampoline systems may be designed with safety enclosures that surround the trampoline's rebounding surface. A typical example of such a trampoline and a safety enclosure is found in the '845 patent. Accordingly, the reader should review the '845 patent for a description of these types of features.

Those of skill in the art will recognize that the system shown in the '845 patent is simply one example of a trampoline and enclosure system that may be used. The accessories within the scope of the present invention may be used with other types of trampoline and enclosure systems. In fact, another type of system, in which the poles that support the enclosure are attached to the trampoline frame via brackets and/or swaging is described U.S. Provisional Patent Application No. 60/684,105 entitled "Trampoline Enclosure Attachment Receptor" (which provisional application is-incorporated herein by reference).

Figure 1:
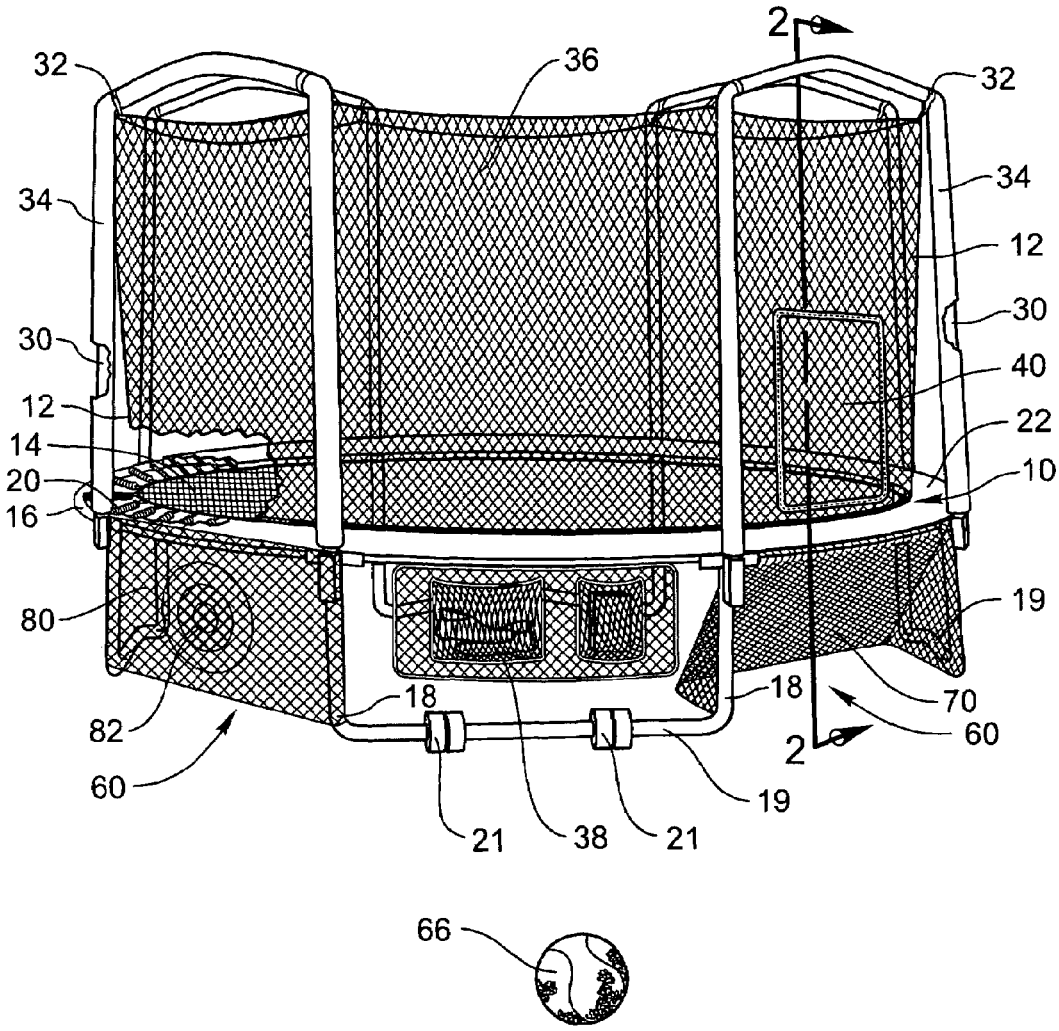
FIG. 1 is a perspective view of trampoline with an enclosure having trampoline accessories according to the present embodiments.

Referring now to FIG. 1, a trampoline 10 and a trampoline enclosure 12 is illustrated. The trampoline will generally include a rebounding mat 14 and a frame 16 that supports the mat 14. The frame will be elevated off the ground by a plurality of the legs 18 that attach to and support the frame 16. As is known in the art, the rebounding mat 14 will be attached to the frame via a plurality of springs 20. Generally, the springs 20 are attached to the frame 16 and the mat 14 in such a way that a user may "jump" on the mat 14. A frame pad 22 may be positioned over the springs 20 to prevent the user from accidentally being injured by jumping on the springs 20 or coming in contact with the frame 16.

As shown in FIG. 1, a pair of the legs 18 may be attached to a support 19 that is positioned on the ground to support the trampoline 10. In some embodiments, one or more of the supports 19 are curved upward such that a middle portion of the support 19 is off of the ground. As desired, one or more wheels 21 may be added to one or more of the supports 19 to facilitate movement of the trampoline 10.

The trampoline enclosure 12 may be, for example, similar to conventional enclosures, including the enclosure taught in the '845 patent. The enclosure 12 may comprise a plurality of poles 30 that are attached to the legs 18. The poles will extend upwards from the legs 18 such that they are positioned above the rebounding mat 14. As is shown in FIG. 1, trampoline enclosure systems may be constructed in which each of the legs 18 is connected to a separate pole 30. Of course, other embodiments may also be constructed in which the number of legs 18 does not correspond to the number of poles 30. Thus, in the embodiment shown in FIG. 1, eight poles 30 are illustrated. Of course, other configurations of the trampoline 10, the poles 30, and/or the enclosure 12 may also be used.

As shown in FIG. 1, the poles 30 include an attachment piece 32 that is designed to connect two adjacent poles 30 together. In general, the attachment piece 32 will include openings that will receive the top of the pole 30, thereby forming an inverted U-shaped structure. Covering 34 may then be added over the top of the poles 30 and the attachment piece 32 to provide additional padding to the user.

The enclosure 12 also comprises a flexible material 36 that is coupled to the poles 30. In many embodiments, this flexible material 36 comprises netting made of polyethylene, nylon and/or other similar fabrics. The flexible material 36 will surround the periphery of the rebounding mat 14 and will be attached to the rebounding mat 14. As is known in the art, this flexible material 36 is designed to absorb the impact of forces, persons, etc. that collide against the enclosure 12 and prevent these individuals, etc. from falling off the rebounding mat 14. In general, the rebounding mat 14 will be coupled to the flexible material 36 through a variety of different methods, including those known methods disclosed in the '845 patent. However, other embodiments may be constructed in which the mat 14 is coupled to the flexible material 36/enclosure 12 via the methods taught in U.S. Provisional Patent Application No. 60/684,107 (which provisional application is expressly incorporated herein by reference).

The flexible material 36 is also connected to the poles 30. This may occur by tying, adhesives, fasteners, threading the poles 30 through openings in the flexible material 36, and/or other methods of attachment known in the art. Other embodiments may have a portion of the flexible material 36 attached to the attachment pieces 32 via ties, loops, etc. A closable opening 40 may also be added to the enclosure 12 to allow a user to access the interior of the enclosure 12 so that he or she may "jump" on the rebounding mat 14. The opening 40 may be "closed" via the use of adhesive, ties, hook and loop fasteners, and/or other mechanisms. One or more pockets 38 may also be added to hold the user's shoes, wallet, possessions, etc.

The trampoline 10 and enclosure 12 may include one or more independent game playing accessories 60. As used herein, the term "independent game playing accessory" or "game playing accessories" refer to features that are added to the trampoline 10 and/or the enclosure 12 that will allow one or more users to play additional games using the trampoline 10 and/or the enclosure 12. These game playing accessories will generally be positioned between two of the poles 30 and/or two of the legs 18. In some embodiments, the game playing accessory 60 will be positioned above the trampoline's rebound mat 14 such that the accessory is positioned between two or more of the poles 30 that support the enclosure 12. Other embodiments may also be constructed in which the accessory is below the rebounding surface such that the accessory is positioned between two or more of the trampoline legs 18 and/or other portions of the frame 16.

In general, the game playing accessories 60 will be designed such that children, teenagers, or adults, may practice or play sports on the exterior of the trampoline even while another user may be using the trampoline 10 with the enclosure 12. Thus, the game playing accessory 60 will be designed such that a ball 66 (such as a soccer ball, a golf ball, a baseball, a football, etc.) may impact and/or contact the accessory 60. Such exterior use of the game playing accessory 60 will not affect another user jumping on the trampoline.

In one embodiment, the game playing accessory will generally comprise a soccer net 70. This soccer net 70 will be positioned proximate the ground such that it is positioned between two or more of the legs 18 of the trampoline. The soccer net 70 is designed similar to the standard-type soccer goals that are used in conjunction with playing soccer. Thus, the soccer net is designed such that a ball may be kicked into the soccer net 70 as a means of scoring a goal in soccer.

Figure 2:
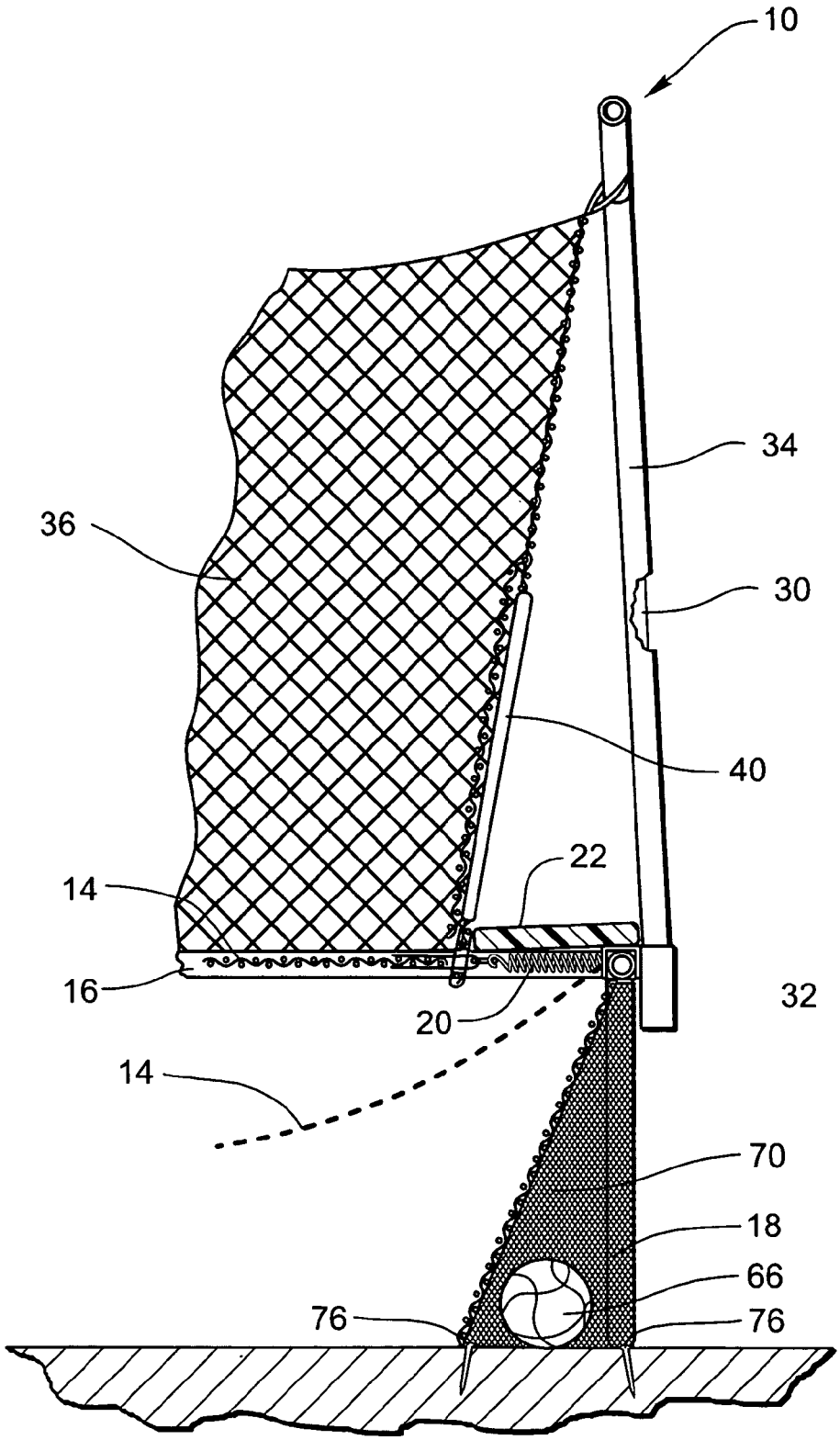
FIG. 2 is a cross-sectional view of one of the accessories of the present embodiments.

Referring now to FIG. 2, a cross-sectional view of the soccer net 70 illustrates one of the features of the present embodiments. Specifically, as shown in FIG. 2, embodiments of the soccer net 70 may further be designed such that a person on the ground may be safely kicking the ball into the soccer net 70 while other persons are jumping on the trampoline 10. In these embodiments, the rear surface of the soccer net will be positioned below the springs 20 so that those persons jumping on the trampoline will not contact the person that is attempting to retrieve the soccer ball from the net 70. In these embodiments, the net may be attached to the legs 18 and/or the rebounding mat 14 through a variety of methods including clips, Velcro® strips, fasteners, etc. If Velcro® strips and/or other removable fasteners are used, the owner can quickly remove the soccer net 70 when the use of the net 70 is no longer desired. Moreover, further embodiments may be constructed (such as the embodiments shown in FIG. 4) in which deflective netting is used. This deflective netting will prevent the ball from going under the rebounding mat 14, in the event that the kicked/thrown ball misses the soccer net 70. Rather, this deflective netting will deflect the ball away and prevent the ball from going under the rebounding mat 14. The deflective netting also prevents users from entering the space below the rebounding mat 14.

Furthermore, as shown in FIG. 2, embodiments may be constructed in which the net is angled from top to bottom—i.e., from the rebounding mat 14 to the ground—as is common in some types of soccer nets. Additionally, removable ground anchors 76 (such as stakes, poles, etc.) may also be added to the bottom of the net to secure the net to the ground. Of course, other embodiments may further be constructed in which the soccer net 70 is positioned above the ground such that the net 70 is attached to two of the poles 30 of the enclosure 12.

Referring again to FIG. 1, an additional embodiment of a game playing accessory 60 is illustrated. Specifically, embodiments may be constructed in which the game playing accessory 60 may comprise a rebound panel 80 that may be positioned either above the rebounding mat 14 or below the rebounding mat 14. The rebound panel 80 is made of a flexible or elastic material (such as netting, nylon mesh, etc.). The panel 80 may be a separate layer of material from the flexible material 36. Specifically, the panel is designed such that if a ball 66 is thrown/kicked/hit against the rebound panel 80, the rebound panel will "return" a ball to the user. In other words, when the ball 66 is thrown/hit/kicked against the panel 80, the panel 80 will cause the ball 66 to rebound away from the rebound panel 80 in a substantially opposite direction, thereby returning the ball 66 to the person that hit/kicked/threw the ball. In essence, this rebound panel 80 will enhance the user's ability to practice kicking/hitting/throwing the ball 66, because the user will not have to waste time retrieving the ball 66.

For decorative purposes, the rebound panel 80 may additionally comprise a target 82 at which the user may aim when kicking/hitting/throwing the ball. In general, the target 82 is a drawing or picture that is added to the panel 80. In some embodiments (including the embodiment shown in FIG. 1), this target 82 may be a round target of the type that is used for archery, darts, etc. In other embodiments, the target 80 may be a "sports scene," such as for example, a picture of a baseball player holding a catcher's mit, a golf hole, a receiver playing football, etc. Thus, by seeing the sports scene, the user can pretend that he or she is actually playing the game and can visualize making a "pitch" to the catcher, throwing the football to the receiver, hitting the golf ball towards the golf hole, etc.

As shown in FIG. 1, the rebound panel 80 is positioned proximate the ground between two of the legs 18. Other embodiments may also be constructed in which the panel 80 is positioned above the ground and/or above the mat 14. In these embodiments, the panel 80 will generally be attached to one or more of the poles 30.

Figure 3:
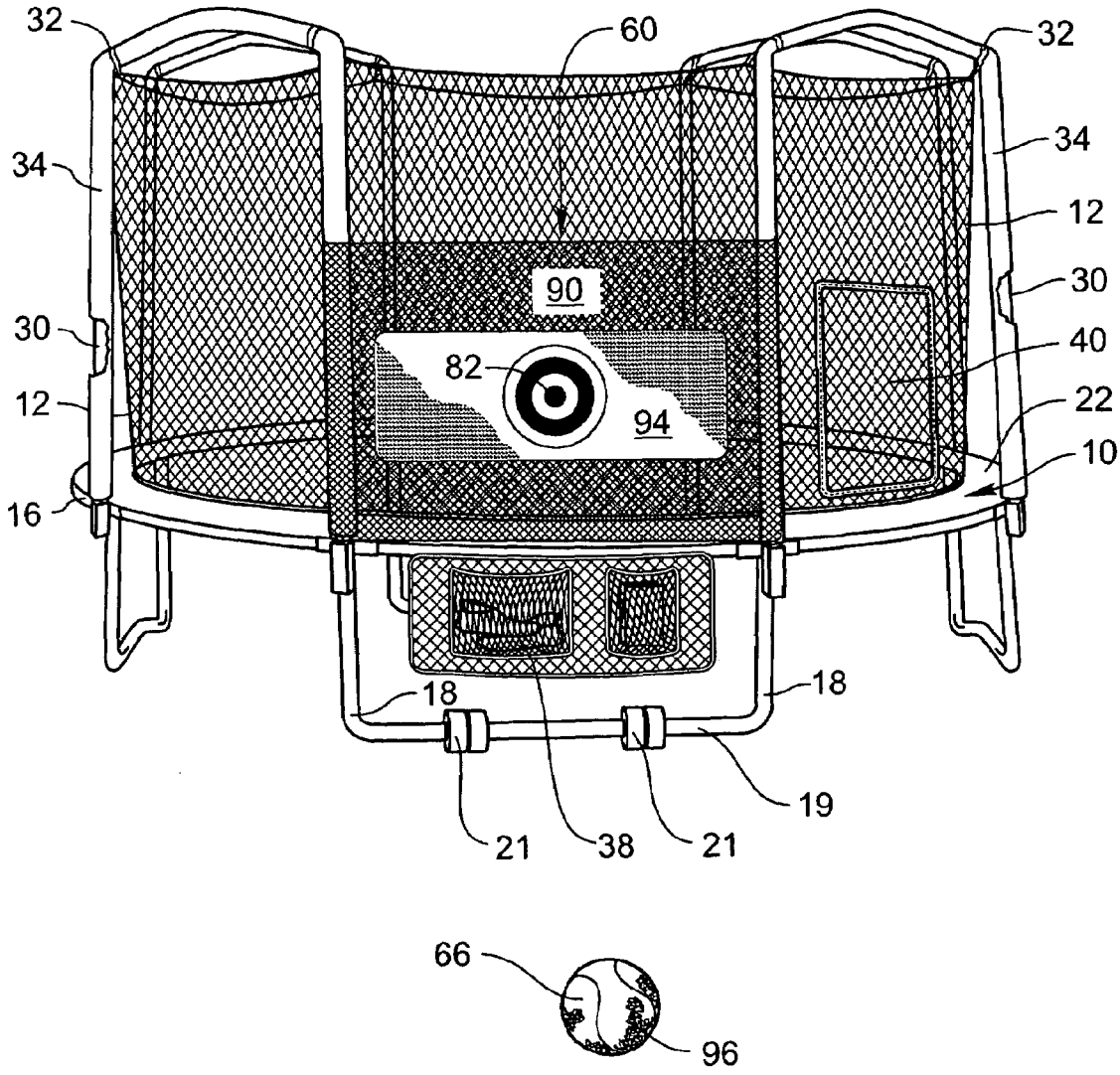
FIG. 3 is a perspective view of trampoline with an enclosure having trampoline accessories according to the present embodiments.

Referring now to FIG. 3, a perspective view illustrates another type of accessory 60 according to the present embodiments. FIG. 3 is a perspective view that is similar to that which is shown in FIG. 1. Specifically, FIG. 3 shows a trampoline 10 with an enclosure 12 that also includes a game playing accessory 60. In this embodiment, the game playing accessory 60 comprises a catch panel 90. Again, depending on the particular embodiment, the catch panel 90 may be positioned above or below the trampoline rebounding mat 14. Thus, in some embodiments, the catch panel 90 will be attached to the legs 18 whereas in other embodiments, the catch panel 90 will be attached to one or more of the poles 30.

The catch panel 90 will generally comprise a receptive surface 94 that is designed to engage and/or capture the ball 66. This may be accomplished by having the receptive surface 94 include Velcro®, glue, grip powder (including Stickum™ brand products) and/or other adhesives designed to catch or retain a ball 66. Thus, when the user throws (or kicks, hits, etc.) the ball against the catch panel, the receptive surface will retain the ball 66. Again, one of the advantages of this catch panel 90 is that the user will not have to spend time retrieving the ball 60.

In order to improve the ability of the ball 66 to engage the receptive surface, adhesive 96 may also be added to the ball 66. "Hook and loop" fasteners, which include Velcro® products, may also be used. In these embodiments, the "hook" portion will preferably be on the receptive surface and the "loop" portion will be on the ball so that the ball will be softer and generally more unobtrusive.

As with the rebounding panel 80 discussed above, the receptive surface 94 and/or the catch panel 90 may (as desired) include a target 82 that will make the game more life-like.

Of course, those of skill in the art will recognize that a variety of other types of game playing accessories may likewise be used. Also, those of skill in the art will recognize how these types of game accessories may be attached (via rope, sewing, fasteners, screws, etc.) to the trampoline and/or the trampoline enclosure.

It will also be noted that the balls that are used in conjunction with the game playing accessories may be "real" balls—i.e. regulation golf balls, baseballs, etc. of the type that would be used in an organized sporting event. Of course, other embodiments may be constructed in which the balls used are softer balls, such as balls made of foam, rubber, etc. Other embodiments may have balls (including golf balls, baseballs, etc.) are perforated and/or hollow.

Figure 4:
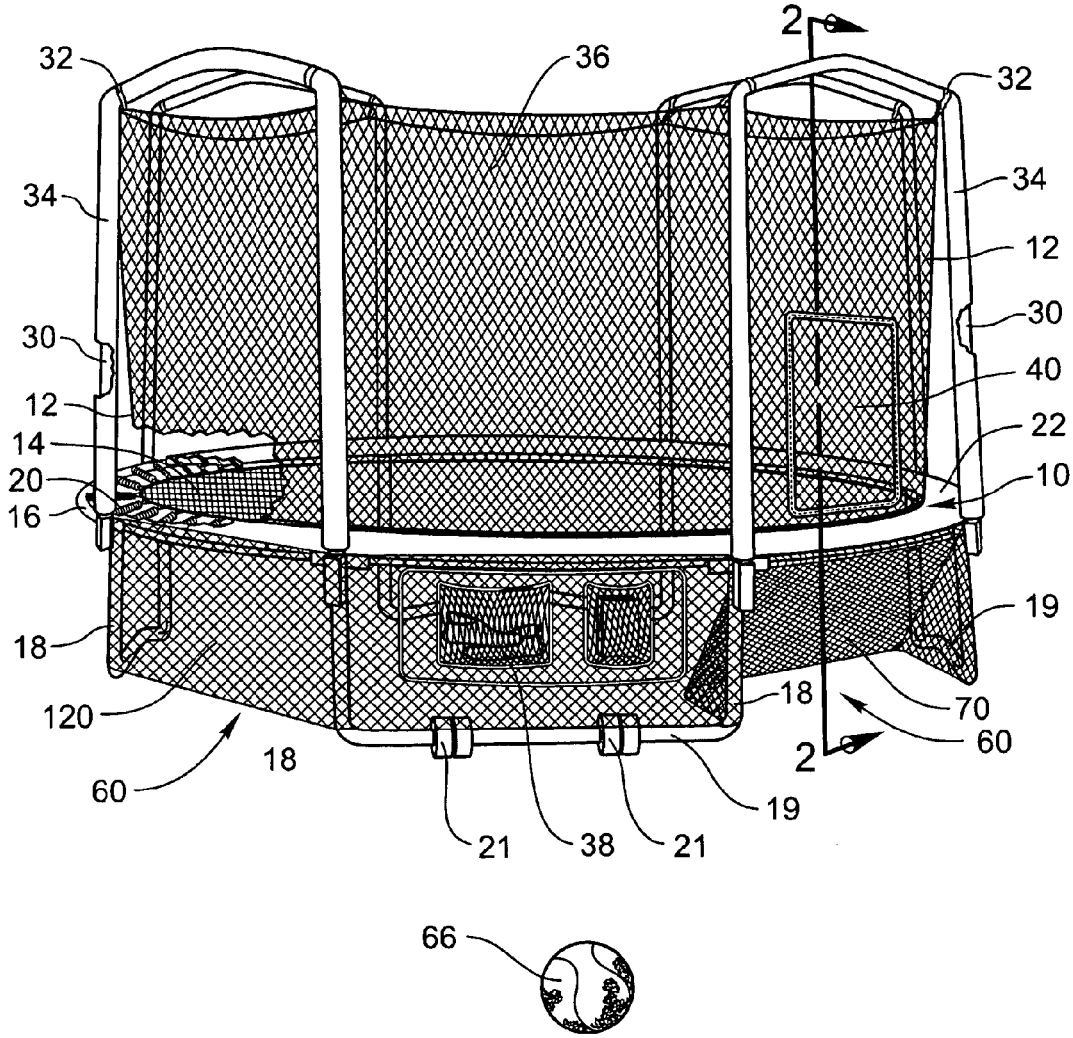
FIG. 4 is a perspective view of a trampoline with the enclosure according to present embodiments.

Referring now to FIG. 4, a perspective view illustrates the trampoline 10, the enclosure 12, and the soccer net 70 shown in FIG. 1. However, as a further embodiment, deflective netting 120 is also added. This deflective netting 120 is attached to the legs 18, poles 30, and/or other portions of the trampoline 10 or the enclosure 12 and will prevent the ball 66 (or a person, animal, etc.) from going underneath the rebounding mat 14. This deflective netting 120 may be nylon, polyethylene, fabric, or other similar materials. Accordingly, in the event that the person that kicks or throws the ball 66 "misses" the soccer net 70 (or the intended target), the ball 66 will impact the deflective netting 120 and will not go underneath the rebounding mat 14. Thus, the possibility that someone jumping on the trampoline 10 will contact a person that is attempting to crawl underneath the rebounding mat 14 (such as to retrieve a ball, etc.) is drastically reduced.

Although the deflective netting 120 is shown with the soccer net 70, similar types of deflective netting 120 may be used with the rebounding panel 80 or the catch panel 90. Other embodiments may be made in which the netting 120 is used with other of the accessories 60.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A trampoline system having a safety enclosure therearound, the trampoline system comprising;

a frame having a plurality of legs;

a rebounding mat coupled to the frame by a plurality of springs;

a plurality of poles, wherein each of the legs is attached to a separate pole and wherein each of the poles extend above the rebounding mat;

the safety enclosure comprising a flexible material coupled to the poles and the rebounding mat; and an independent game playing accessory, wherein the accessory is positioned between two of the poles or two of the legs, and wherein the accessory has an exterior surface facing away from the rebounding mat designed and configured to receive the impact of a ball moving towards the exterior surface from a user outside of the trampoline system.

2. A trampoline system as in claim 1 further comprising deflective netting disposed between poles or legs adjacent to the game playing accessory.

3. A trampoline system as in claim 1 wherein the accessory is a soccer net that is positioned between two of the legs.

4. A trampoline system as in claim 3 wherein the back edge of the soccer net is positioned under the plurality of springs.

5. A trampoline system as in claim 1 wherein the accessory is a rebound panel of flexible material.

6. A trampoline system as in claim 5 wherein the accessory is constructed such that when a ball impacts the rebound panel, the ball will rebound away from the rebound panel in a substantially opposite direction.

7. A trampoline system as in claim 5 wherein the rebound panel further comprises a target.

8. A trampoline system as in claim 1 wherein the accessory is a catch panel having a receptive surface.

9. A trampoline system as in claim 8 wherein the catch panel and the ball are designed and configured such that when the ball impacts the catch panel, the receptive surface will engage and retain the ball.

10. A trampoline system having a safety enclosure therearound, the trampoline system comprising;

a frame having a plurality of legs;

a rebounding mat coupled to the frame by a plurality of springs;

a plurality of poles, wherein each of the legs is attached to a separate pole and wherein each of the poles extend above the rebounding mat;

the safety enclosure comprising a flexible material coupled to the poles and the rebounding mat; and an independent game playing catch panel having a receptive surface, wherein the receptive surface is positioned between two of the poles or two of the legs, and wherein the receptive surface is designed and configured to receive the impact of a ball and wherein the receptive surface is made of an adhesive.

11. A trampoline system having a safety enclosure therearound, the trampoline system comprising;

a frame having a plurality of legs;

a rebounding mat coupled to the frame by a plurality of springs;

a plurality of poles, wherein each of the legs is attached to a separate pole and wherein each of the poles extend above the rebounding mat;

the safety enclosure comprising a flexible material coupled to the poles and the rebounding mat; and an independent game playing catch panel having a receptive surface, wherein the receptive surface is positioned between two of the poles or two of the legs, and wherein the receptive surface is designed and configured to receive the impact of a ball and wherein the receptive surface comprises a hook and loop fastener.

12. A trampoline system as in claim 8 wherein the catch panel includes a target.

13. An independent game playing accessory sized and configured for use with a trampoline system having a safety enclosure therearound, the trampoline system comprising a frame having a plurality of legs, a rebounding mat coupled to the frame by a plurality of springs, a plurality of poles, wherein each of the legs is attached to a separate pole and wherein each of the poles extend above the rebounding mat, and the safety enclosure comprising a flexible material coupled to the poles and the rebounding mat, wherein the accessory has an exterior surface facing away from the rebounding mat designed and configured to receive the impact of a ball moving towards the exterior surface from a user outside of the trampoline system.

14. An independent game playing accessory as in claim 13 further comprising deflective netting size and configured to be disposed between poles or legs adjacent to the game playing accessory.

15. An independent game playing accessory as in claim 13 wherein the accessory is a soccer net.

16. An independent game playing accessory as in claim 13 wherein the accessory is a catch panel having a receptive surface.

17. An independent game playing accessory as in claim 13 wherein the accessory is a rebound panel.

* * * * *